US007107911B2

(12) United States Patent
Suh

(10) Patent No.: US 7,107,911 B2
(45) Date of Patent: Sep. 19, 2006

(54) OVERHEAD TRANSPORT APPARATUS

(75) Inventor: Yong jin Suh, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/635,523

(22) Filed: Aug. 7, 2003

(65) Prior Publication Data

US 2004/0107862 A1 Jun. 10, 2004

(30) Foreign Application Priority Data

Dec. 6, 2002 (KR) ..... 10-2002-0077403

(51) Int. Cl.
*B61B 3/00* (2006.01)
*E01B 25/22* (2006.01)

(52) U.S. Cl. ..... 104/91; 105/148

(58) Field of Classification Search ..... 104/89, 104/90, 91, 93, 95, 130.01; 105/148, 150, 105/155

See application file for complete search history.

(56) References Cited

U.S. PATENT DOCUMENTS 4,203,369 A * 5/1980 Perrott ..... 104/130.07
5,060,575 A * 10/1991 Hallett et al. ..... 104/130.07
6,095,054 A * 8/2000 Kawano et al. ..... 104/139
6,629,502 B1 * 10/2003 Matsukawa ..... 104/96
6,644,208 B1 * 11/2003 Akiyama ..... 104/130.01

FOREIGN PATENT DOCUMENTS

| | | |
|---|---|---|
| JP | 11-222122 | 8/1999 |
| JP | 2001-328530 | 11/2001 |
| JP | 2002-87250 | 3/2002 |
| JP | 2002-87251 | 3/2002 |
| KR | 1999-0071350 | 9/1999 |
| KR | 2002-0021357 | 3/2002 |

* cited by examiner

*Primary Examiner*—S. Joseph Morano
*Assistant Examiner*—Robert J. McCarry, Jr.
(74) *Attorney, Agent, or Firm*—Staas & Halsey LLP

(57) ABSTRACT

An overhead transport apparatus includes a guide rail unit having a main rail having a pair of rail members, and a branch rail branching off the main rail; an auxiliary guide rail provided along the branch rail at an upper part of a branching region in which the branch rail branches off the main rail; a transport vehicle having a vehicle body, a pair of wheels attached to the vehicle body and moving along the guide rail unit, and a driving motor mounted on the vehicle body and driving the wheels; a roller provided in the transport vehicle, and ascending in order to move the transport vehicle toward the branch rail with the auxiliary guide rail, or descending in order to move the transport vehicle toward the main rail; and a control part controlling the ascending/descending movement of the roller.

23 Claims, 5 Drawing Sheets

OVERHEAD TRANSPORT APPARATUS

CROSS-REFERENCE TO RELATED APPLICATIONS

This application claims the benefit of Korean Application No. 2002-77403, filed Dec. 6, 2002, in the Korean Intellectual Property Office, the disclosure of which is incorporated herein by reference.

BACKGROUND OF THE INVENTION

1. Field of the Invention

The present invention relates to an overhead transport apparatus, more particularly, to an overhead transport apparatus installed on a ceiling of a building to transport articles.

2. Description of the Related Art

Generally, an overhead transport apparatus includes a guide rail unit installed on a ceiling of a building such as a hospital or a semiconductor factory, and a transport vehicle adapted to hold an article, such as a semiconductor and to move along a guide rail.

The guide rail unit of the transport apparatus generally includes a main rail and a branch rail branching off the main rail.

A conventional overhead transport apparatus including a guide rail unit, and a moving body supported and guided by the guide rail unit and moving on the guide rail unit, is disclosed in Korean Patent Application No. 2001-56773.

The guide rail unit includes a pair of rail members. Each rail member is formed with an upward wheel supporting plane and an inward roller guide plane. The guide rail unit includes a linear rail part and a branch rail part branching off the linear rail part. A linear guide member and a branch guide member are installed in a joint part of the linear rail part and the branch rail part.

The moving body is provided with a wheel supported and guided by the wheel supporting plane, a side guide roller guided by the roller guide plane, and a direction regulating roller guided by a transverse guide part of the branch guide member to regulate a direction of the moving body.

The direction regulating roller moves freely between a position corresponding to the linear guide member and a position corresponding to the branch guide member by a moving means to move the direction regulating roller right and left.

The moving means includes a supporter connected to the direction regulating roller, a guide load guiding the supporter, a cam roller having a spiral groove engaged with a cam moving part provided in the supporter, and a driving part (driving motor) to drive the cam roller.

Thus, the direction regulating roller provided in the conventional transport equipment moves right and left by the moving means and is selectively guided to the linear guide member or the branch guide member, to thereby move the moving body toward the linear rail part or the branch rail part.

However, according to the conventional transport equipment, the linear guide member and the branch guide member are respectively provided along the linear rail part and the branch rail part in the joint part of the linear route and the branch rail, thereby making the structure more complex. Also, the configuration of the moving means to move the direction regulating roller right and left so that the direction regulating roller can be guided to the linear guide member or to the branch guide member is complex. Accordingly, there are problems in that failures and repair costs are increased, as well as there being increased manufacturing costs.

SUMMARY OF THE INVENTION

Accordingly, it is an aspect of the present invention to provide an overhead transport apparatus having a simple configuration and reducing manufacturing and repair costs as well as preventing breakdowns.

Additional aspects and advantages of the invention will be set forth in part in the description which follows and, in part, will be obvious form the description, or may be learned by practice of the invention.

The foregoing and/or other aspects of the present invention are achieved by providing an overhead transport apparatus, including a guide rail unit including a main rail having a pair of rail members, a branch rail, and a branching region, the branch rail branching off the main rail at the branching region; an auxiliary guide rail provided along the branch rail at an upper part of a branching region of the guide rail unit in which the branch rail branches off the main rail; a transport vehicle including a vehicle body, a pair of wheels attached to the vehicle body and moving along the guide rail unit, and a driving motor mounted on the vehicle body and driving the wheels; a roller provided in the transport vehicle, and moving in a first direction to move the transport vehicle toward the branch rail via the auxiliary guide rail, or moving in a second direction opposite to the first direction in order to move the transport vehicle toward the main rail; and a control part to control movement of the roller in the first and second directions.

Each rail member may include a guide projection extending from an inward bent portion of the rail member, and the guide projections each have a cutoff part so that the wheels of the transport vehicle can travel along the main rail or the branch rail at the branching region of the guide rail unit.

The auxiliary guide rail may be installed in an upper part of the rail member provided in the branch rail at the branching region.

The overhead transport apparatus may further include a supporting shaft rotatably supporting the roller and formed with a male thread on the outer surface thereof, wherein the vehicle body includes a vehicle body cover which the supporting shaft passes through and is engaged therewith, a shaft driving motor driving the supporting shaft to move in the first and second directions, and a supporter engaged to the vehicle body cover and formed with a female thread engaged with the threaded supporting shaft.

A pulley formed with a female thread may be provided in the supporting shaft, and the pulley may be connected to the shaft driving motor by a belt.

The transport vehicle may include a pair of guide rollers guided and slidably contacting the lower end part of the rail member.

The overhead transport apparatus may further include a connection unit interposed between the pair of the rail members, and connecting the transport vehicle and an article to be transported by the transport vehicle; a noncontact power supply cable; and a pickup coil receiving power from the noncontact power supply cable.

The control part may control the shaft driving motor.

The transport vehicle may be provided in pairs which are connected to each other.

BRIEF DESCRIPTION OF THE DRAWINGS

These and/or other aspects and advantages of the invention will become apparent and more readily appreciated from the following description of the preferred embodiment, taken in conjunction with the accompanying drawings of which.

DETAILED DESCRIPTION OF THE PREFERRED EMBODIMENTS

Figure 1:
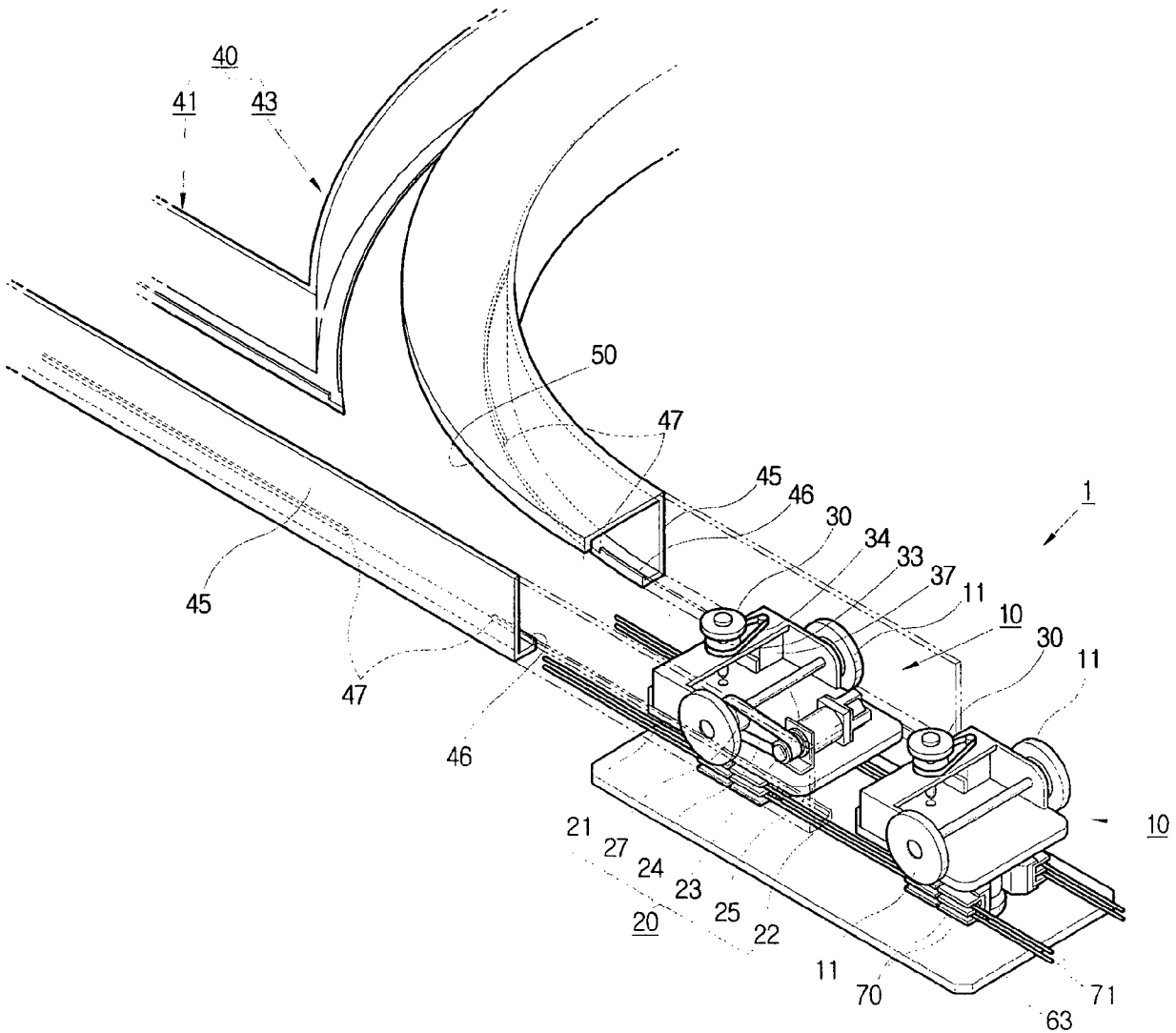
FIG. 1 is a perspective view of an overhead transport apparatus according to an embodiment of the present invention.
Figure 2:
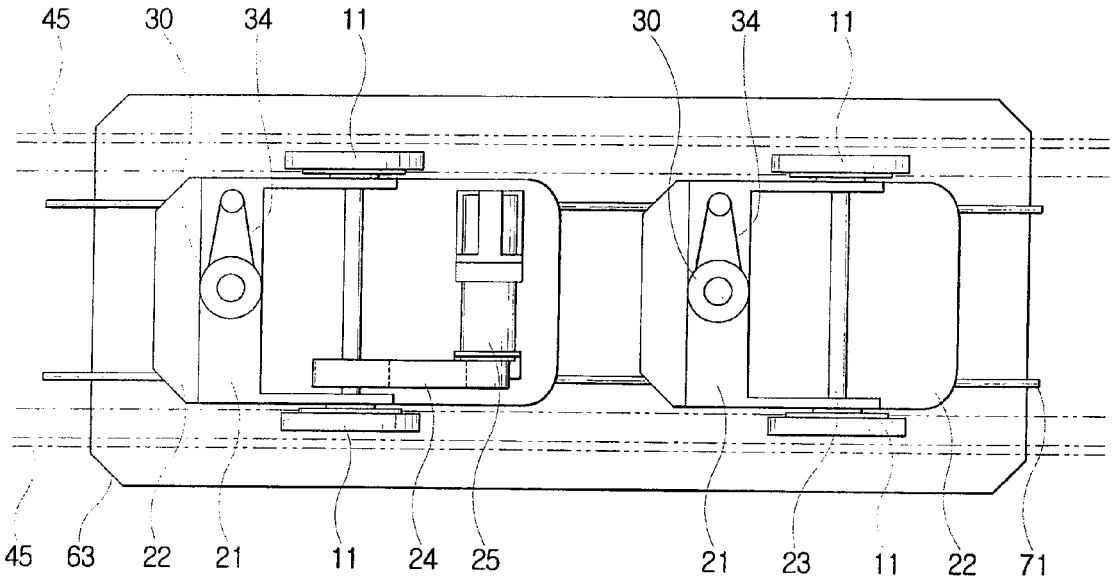
FIG. 2 is a plan view of a transport vehicle of the overhead transport apparatus according to the embodiment of the present invention.

Reference will now be made in detail to the present preferred embodiment of the present invention, an example of which is illustrated in the accompanying drawings, wherein like reference numerals refer to like elements throughout.

Figure 3:
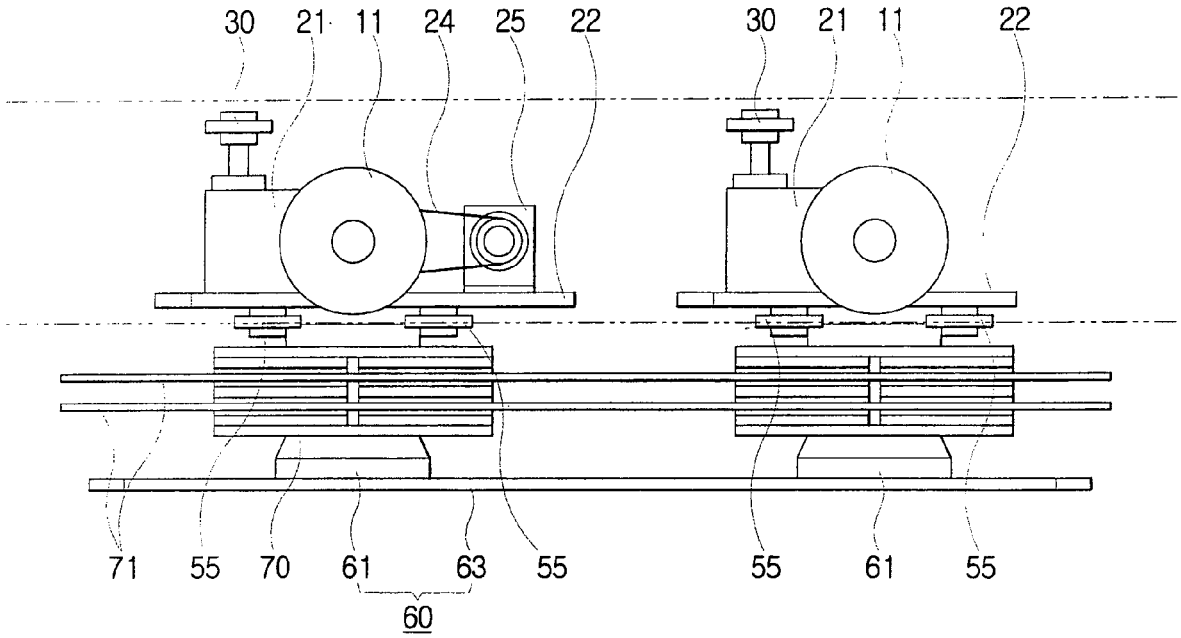
FIG. 3 is a side view of the transport vehicle of the overhead transport apparatus according to the embodiment of the present invention.
Figure 5:
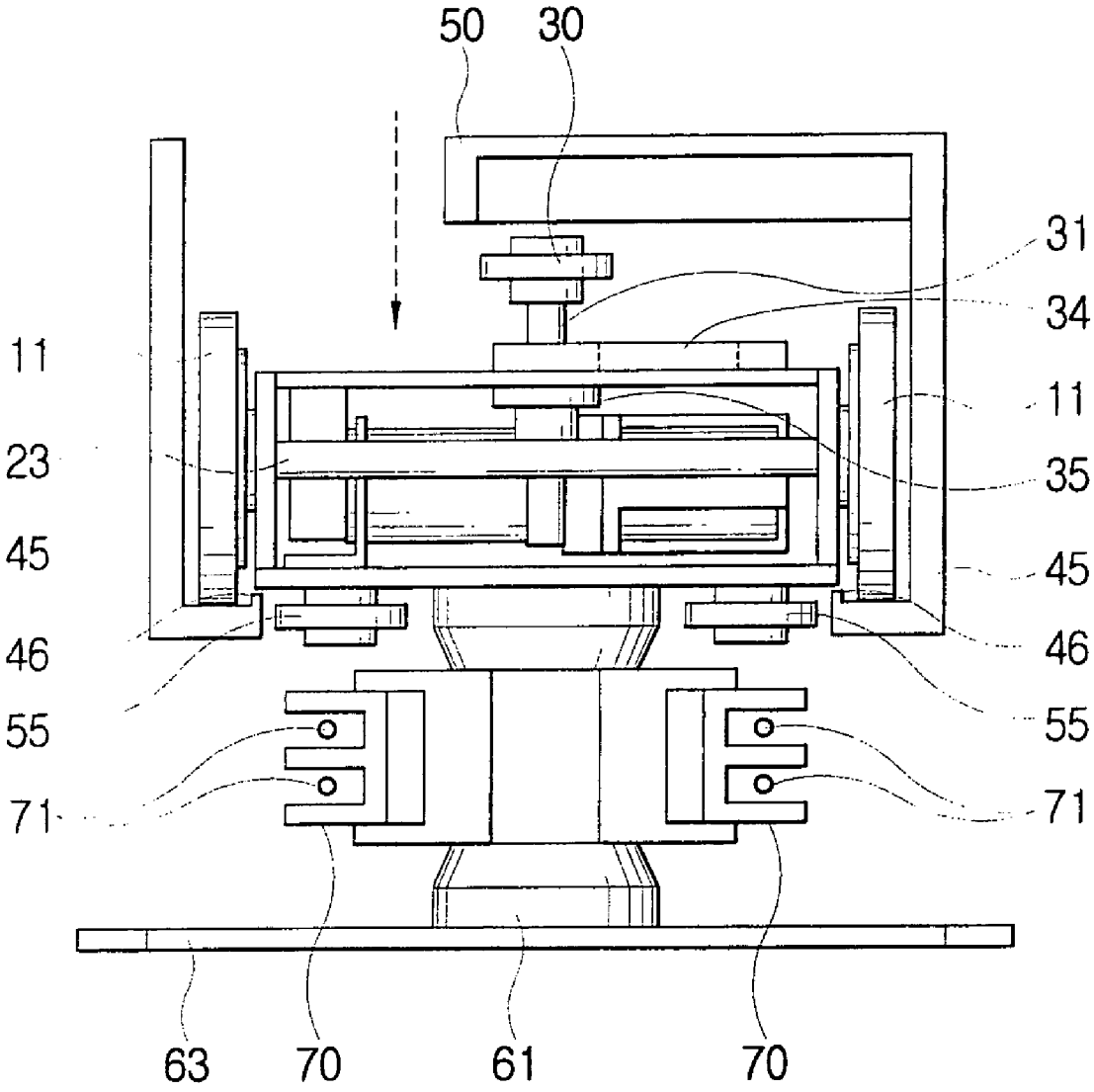
FIG. 5 is a cross sectional view illustrating a descending state of the roller of the embodiment of the present invention.

As shown in FIGS. 1 and 5, an overhead transport apparatus 1 according to an embodiment of the present invention includes a guide rail unit 40 having a main rail 41 having a pair of rail members 45, and a branch rail 43 branching off the main rail 41; and an auxiliary guide rail 50 engaged with an upper part of the rail member 45 at a branching region in which the branch rail 43 branches off the main rail 41 and provided along the branch rail 43. The apparatus 1 further includes a transport vehicle 10 having a vehicle body 20, a pair of wheels 11 provided in the vehicle body 20 and moving along the guide rail unit 40, and a driving motor 25 provided in the vehicle body 20 and driving the wheels 11. The apparatus 1 further includes a roller 30 provided in the transport vehicle 10 to ascend so that the transport vehicle 10 can be guided by the auxiliary guide rail 50 and moved toward the branch rail 43, or to descend so that the transport vehicle 10 can move toward the main rail 41. The apparatus 1 further includes a control part (not shown) to control vertical movement of the roller 30; and a connection unit 60 (refer to FIG. 3) interposed between the pair of rail members 45 and connecting a lower part of the transport vehicle 10 and an article (not shown) to be transported by the transport vehicle 10.

The guide rail unit 40 includes the pair of the rail members 45 and is installed on a ceiling of a building to transport an article below the rail members 45. Also, the guide rail unit 40 includes the main rail 41 to allow the transport vehicle 10 to travel in a linear direction, and the branch rail 43 branching off the main rail 41.

The rail members 45 include a guide projection 46 extending upward from a bottom part bent inward from the lower end part of the rail member 45. The wheels 11 of the transport vehicle 10 are movably supported by the lower side of the rail member 45. A lower end part of the rail member 45 contacts the guide roller 55 and guides the guide roller 55. An upper part of the rail member 45 is engaged to an upper part of a building, such as a ceiling on which the guide rail unit 40 is installed, by a rail supporter (not shown). The guide projection 46 of the rail member 45 has a cutoff part 47 so that the wheels 11 of the transport vehicle 10 travel along the main rail 41 or along the branch rail 43 at the branching region of the guide rail unit 40. The guide projection 46 of the rail member 45 allows the wheels 11 to travel along the guide rail unit 40 more safely.

The auxiliary guide rail 50 is engaged to the upper part of the rail member 45 at an upper part of the branching region so that the roller 30 slidably contacts the auxiliary guide rail 50 in a predetermined section along the branch rail 43 and thus guides the transport vehicle 10 toward the branch rail 43.

The transport vehicle 10 includes the vehicle body 20, and a pair of the wheels 11 provided in the vehicle body 20 and moving along the guide rail unit 40.

The vehicle body 20 includes a vehicle body base 22; a vehicle body cover 21 provided in right and left sides thereof and an upper part of the vehicle body base 22; and a wheel shaft 23 engaged with the vehicle body cover 21 and rotatably supporting the wheels 11. A driving motor 25 drives the wheel shaft 23 by using a driving belt 24 such as a timing belt and a driving pulley 27; and a pulley 33 rotatably supporting the roller 30, engaged with a supporting shaft 31 (FIG. 4) passing through a plane of the vehicle body cover 21 and rotatably engaged to an upper side of the plane of the vehicle body cover 21. The vehicle body 20 further includes a shaft driving motor 37 to drive the pulley 33 by using a belt 34; and a supporter 35 provided in a lower side of the plane of the vehicle body cover 21 through which the supporting shaft 31 passes, and accommodating and supporting the supporting shaft 31.

The supporting shaft 31 is formed with a male thread on the outer surface thereof, while the pulley 33 and the supporter 35 are formed with a female thread engaged with the supporting shaft 31. The supporting shaft 31 is rotatably screw-engaged with the pulley 33 and the supporter 35. Accordingly, if the pulley 33 is rotated by a driving of the shaft driving motor 37, the supporting shaft 31 is rotated. Also, the supporter 35 to support the supporting shaft 31 is immovably engaged to the lower side of the plane of the vehicle body cover 21, so that the supporting shaft 31, rotating relative to the supporter 35, ascends. Further, the pulley 33 is engaged to the upper side of the plane of the vehicle body cover 21 so as not to ascend, while the pulley 33 can be rotated relative to the upper side of the plane of the vehicle body cover 21. Furthermore, by switching a driving direction of the shaft driving motor 37, the supporting shaft 31 can ascend or descend, rotating relative to the supporter 35.

On a lower side of the vehicle body 20 of the transport vehicle 10 are provided a pair of the guide rollers 55 respectively slidably contacting and guided by the lower end parts of the pair of the rail members 45.

The guide rollers 55 are provided respectively in a front and in a rear of the vehicle body 20 in pairs, freely rotatably engaged to a lower side of the vehicle body 20. Thus, when the transport vehicle 10 travels along the guide rail unit 40, the guide roller 55 slidably contacts with the lower end part of the rail member 45 and guides the transport vehicle 10 more safely.

The transport vehicle 10 may be provided in pairs. The configuration of the transport vehicle 10 described above corresponds to the front transport vehicle 10, while the rearward transport vehicle 10 has a similar configuration, with the exception that there is no driving motor 25 to drive the pair of the wheels 11 in the rearward transport vehicle 10.

The connection unit 60 passes between the pair of the rail members 45. The connection unit 60 includes a connection member 61 engaged to a lower part of the vehicle body 20; and a connection plate 63 provided between the connection member 61 and an article (not shown) to be transported, and holding the transported article.

The connection members 61 are respectively provided in the forward and backward transport vehicles 10. The connection plate 63 is provided in a lower part of the pair of the connection members 61 and connects the forward and backward transport vehicles 10. The connection member 61 and the connection plate 63 are engaged rotatably, to thereby enable the forward and backward transport vehicles 10 to travel easily in a curve such as the branch rail 43 of the guide rail unit 40.

A pickup coil 70, receiving power from a noncontact power supply cable 71 connected to a high frequency power supply (not shown), is installed in the connection member 61.

The noncontact power supply cable 71 is installed along the guide rail unit 40 at a lower part of the guide rail unit 40, and the pickup coil 70 is installed in the connection member 61 and moves with the transport vehicle 10. If power is supplied to the high frequency power supply, power is generated in the pickup coil 70 through the noncontact power supply cable 71 and the power generated in the pickup coil 70 is controllably supplied to the driving motor 25, the shaft driving motor 37 and so on by a control part.

The control part controls the driving motor 25 of the transport vehicle 10 so that the transport vehicle 10 can travel along the guide rail unit 40. The control part also controls the shaft driving motor 37, enabling the roller 30 to ascend/descend by determining whether the transport vehicle 10 travels along the main rail 41 or along the branch rail 43.

The roller 30 is provided on an upper part of the vehicle body 20, is rotatably engaged by the supporting shaft 31 and moves up and down by the shaft driving motor 37. The rollers 30 are provided in both the forward and backward transport vehicles 10, respectively.

If the roller 30 ascends at the transport vehicle 10, the roller 30 is guided by the auxiliary guide rail 50, to thereby make the transport vehicle 10 travel along the branch rail 43. On the contrary, if the roller 30 descends at the transport vehicle 10, the roller 30 is not guided by the auxiliary guide rail 50, to thereby make the transport vehicle 10 travel along the main rail 41.

With the above configuration, an operation of the transport apparatus 1 according to the present embodiment will be described.

Figure 4:
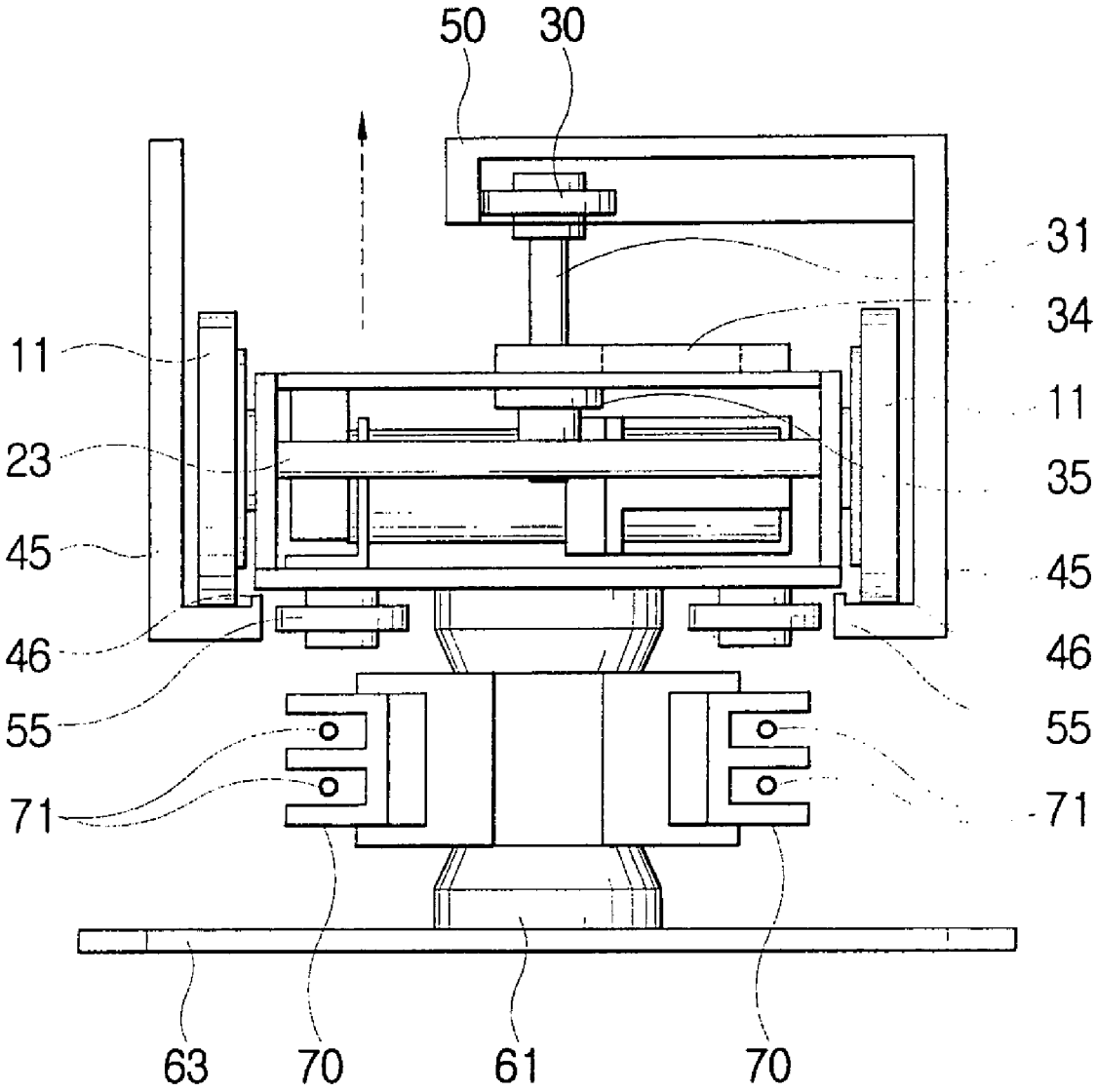
FIG. 4 is a cross sectional view illustrating an ascending state of a roller of the the embodiment of the present invention.

First, if an article to be transported is held by the connection unit 60 of the transport vehicle 10, the driving motor 25 of the transport vehicle 10 is operated by the control part by using the power generated through the noncontact power supply cable 71 and the pickup coil 70. Accordingly, the transport vehicle 10 travels along the main rail 41 provided forward of the branching region. If the transport vehicle 10 reaches the branching region of the guide rail unit 40, the control part discerns the article held by the transport vehicle 10 and determines whether the transport vehicle 10 travels along the main rail 41 continuously, or along the branch rail 43. If the transport vehicle 10 travels along the branch rail 43, as shown in FIG. 4, the control part controls the shaft driving motor 37 in order to move the roller 30 upwards so that the roller 30 can be guided by the auxiliary guide rail 50. On the contrary, if the transport vehicle 10 travels along the main rail 41 continuously, as shown in FIG. 5, the control part controls the shaft driving motor 37 to move the roller 30 down so that the roller 30 cannot be guided by the auxiliary guide rail 50. Accordingly, the transport vehicle 10 travels along the main rail 41 because the pair of the wheels 11 rotating at a same speed have a tendency to move straight. The guide projection 46 guiding movement of the wheels 11 is provided in the rail member 45 of the guide rail unit 40 so that the transport vehicle 10 can travel relatively easily along the guide rail unit 40. The cutoff part 47 is provided in the guide projection 46 so that the transport vehicle 10 can move toward the main rail 41 or the branch rail 43.

When the transport vehicle 10 travels in the branching region of the guide rail unit 40, one of the wheels 11 of the transport vehicle 10 moves in a section without the rail member 45. In the case that the transport vehicle 10 travels along the branch rail 43, the roller 30 is guided and supported by the auxiliary guide rail 50, so that one of the wheels 11 can move easily in the section without the rail member 45. On the contrary, if the transport vehicle 10 travels along the main rail 41 continuously, a gap between the pair of the rail members 45 needs to be minimized, a diameter of the wheels 11 needs to be relatively maximized, and the guide projection 46 of the rail member 45 supporting one of the wheels 11 supports and guides the wheels 11 toward the main rail 41 so that the pair of the wheels 11 can move easily toward the main rail 41. Also, if the transport vehicle 10 travels along the main rail 41 continuously, passing through the branching region, each pair of the wheels 11, four wheels in total, are provided in the forward and the backward transport vehicles 10 and thus the transport vehicle 10 can travel along the main rail 41 even though one of the wheels 11 is not supported by the rail member 45.

As the result, the transport vehicle 10 can travel easily along the main rail 41 or the branch rail 43.

Thus, the transport apparatus 1 according to the embodiment of the present invention has a relatively simple configuration to prevent breakdown. Also, manufacturing and repair costs are reduced by providing the auxiliary guide rail 50 along the branch rail 43 at the branching region in which the branch rail 43 branches off the main rail 41, and by providing the roller 30 to ascend/descend at the upper part of the transport vehicle 10. In the lower end parts of the rail members 45, the guide projections 46 are provided, to thereby enable the wheels 11 to travel along the guide rail unit 40 more safely.

In the above embodiment, a pair of the transport vehicles 10 are provided, and the rear transport vehicle 10 does not have the driving motor 25, but the rear transport vehicle 10 can also have the driving motor 25 to drive the pair of the wheels 11.

As described above, according to the embodiment of the present invention, the structure of the apparatus is simplified, so that breakdown can be prevented, and also manufacturing and repair costs can be reduced. Also, a guide projection is provided in a rail member, so that wheels can travel more safely.

Although a preferred embodiment of the present invention has been shown and described, it will be appreciated by those skilled in the art that changes may be made in this embodiment without departing from the principles and spirit of the invention, the scope of which is defined in the claims and their equivalents.

What is claimed is:

1. An overhead transport apparatus, comprising:

a guide rail unit, comprising:

a main rail having a pair of rail members, a branch rail, and a branching region, the branch rail branching off the main rail at the branching region;

an auxiliary guide rail provided along the branch rail at an upper part of the branching region;

a transport vehicle comprising:

a vehicle body, a pair of wheels attached to the vehicle body and moving along the guide rail unit, and a driving motor mounted on the vehicle body and driving the wheels;

a single roller provided in the transport vehicle, to move in a first direction to move the transport vehicle toward the branch rail via the auxiliary guide rail, or to move in a second direction opposite to the first direction in order to move the transport vehicle toward the main rail;

a control part to control movement of the roller in the first and second directions; and a supporting shaft rotatably supporting the roller and formed with a male thread on an outer surface thereof, wherein the vehicle body comprises:

a vehicle body cover which the supporting shaft passes through and is engaged therewith, a shaft driving motor driving the supporting shaft to move in the first and second directions, and a supporter engaged to the vehicle body cover and formed with a female thread engaged with the male thread of the supporting shaft.

2. The overhead transport apparatus according to claim 1, wherein each rail member includes a guide projection extending from an inward bent portion of the rail member, and the guide projections each have a cutoff part so that the wheels of the transport vehicle can travel along the main rail or the branch rail at the branching region of the guide rail unit.

3. The overhead transport apparatus according to claim 2, wherein the auxiliary guide rail is installed in an upper part of the rail members provided in the branch rail at the branching region.

4. The overhead transport apparatus according to claim 1, further comprising a pair of the transport vehicles rotatably connected to each other.

5. An overhead transport apparatus, comprising:

a guide rail unit, comprising:

a main rail having a pair of rail members, a branch rail, and a branching region, the branch rail branching off the main rail at the branching region;

an auxiliary guide rail provided along the branch rail at an upper part of the branching region;

a transport vehicle comprising:

a vehicle body, a pair of wheels attached to the vehicle body and moving along the guide rail unit, and a driving motor mounted on the vehicle body and driving the wheels;

a roller provided in the transport vehicle, to move in a first direction to move the transport vehicle toward the branch rail via the auxiliary guide rail, or to move in a second direction opposite to the first direction in order to move the transport vehicle toward the main rail;

a control part to control movement of the roller in the first and second directions; and a supporting shaft rotatably supporting the roller and formed with a male thread on an outer surface thereof, wherein the vehicle body comprises:

a vehicle body cover which the supporting shaft passes through and is engaged therewith, a shaft driving motor driving the supporting shaft to move in the first and second directions, and a supporter engaged to the vehicle body cover and formed with a female thread engaged with the male thread of the supporting shaft.

6. The overhead transport apparatus according to claim 5, further comprising a belt, wherein the supporting shaft comprises a pulley formed with a female thread, the pulley being connected to the shaft driving motor by the belt.

7. The overhead transport apparatus according to claim 6, wherein the transport vehicle includes a pair of guide rollers guided and slidably contacting the rail members.

8. The overhead transport apparatus according to claim 7, further comprising:

a connection unit interposed between the pair of rail members, and connecting the transport vehicle and an article to be transported by the transport vehicle;

a noncontact power supply cable; and a pickup coil receiving power from the noncontact power supply cable.

9. The overhead transport apparatus according to claim 8, wherein the control part controls the shaft driving motor.

10. The overhead transport apparatus according to claim 9, further comprising a pair of the transport vehicles rotatably connected to each other.

11. An apparatus, comprising:

a first rail unit;

a second rail unit branching from the first rail unit;

a vehicle comprising a single roller, the vehicle to move along either the first or the second rail unit based upon a respective first or second position of the roller; and a supporting shaft rotatably supporting the roller and formed with a male thread on an outer surface thereof, wherein the vehicle body comprises:

a vehicle body cover which the supporting shaft passes through and is engaged therewith, a shaft driving motor driving the supporting shaft to move in the first and second positions, and a supporter engaged to the vehicle body cover and formed with a female thread engaged with the male thread of the supporting shaft.

12. The apparatus according to claim 11, wherein the vehicle moves along the second rail unit when the roller is in a first position, and the vehicle does not move along the second rail unit when the roller is in a second position, the roller being closer to the rail units when in the second position than when in the first position.

13. The apparatus according to claim 12, wherein the second rail unit comprises a projection to receive the roller when the roller is in the first position, and not receiving the roller when the roller is in the second position.

14. The apparatus according to claim 13, further comprising a plurality of the vehicles connected to each other.

15. The apparatus according to claim 13, wherein the vehicle is disposed between the second rail unit and the projection.

16. The apparatus according to claim 13, further comprising a plurality of the vehicles connected to each other in a front/rear arrangement.

17. The apparatus according to claim 16, further comprising a drive motor in the rear vehicle to drive the rear vehicle.

18. The apparatus according to claim 16, further comprising a drive motor in the front vehicle to drive the front vehicle.

19. The apparatus according to claim 16, wherein the roller is in the rear vehicle.

20. The apparatus according to claim 16, wherein the roller is in the front vehicle.

21. The apparatus according to claim 12, wherein the first and second rail units are installed on a ceiling of a building.

22. The apparatus according to claim 12, further comprising a connection plate to connect the vehicle and an article to be transported by the vehicle, the rail units being between the vehicle and the connection plate.

23. The apparatus according to claim 11, wherein the vehicle comprises a plurality of wheels to move along the respective rail units.

* * * * *